US011149515B1

(12) United States Patent
Bull et al.

(10) Patent No.: US 11,149,515 B1
(45) Date of Patent: Oct. 19, 2021

(54) MULTIPLE DOWN-HOLE TOOL INJECTION SYSTEM AND METHOD

(71) Applicant: HALLIBURTON ENERGY SERVICES, INC., Houston, TX (US)

(72) Inventors: Brad Robert Bull, Duncan, OK (US); Tim H. Hunter, Duncan, OK (US); Kurt Rohrbough Harpold, Jr., Kingwood, TX (US); William Joe Robinson, Marlow, OK (US); Glen L. Handke, Duncan, OK (US); Chad Adam Fisher, Cache, OK (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 28 days.

(21) Appl. No.: 16/894,502

(22) Filed: Jun. 5, 2020

(51) Int. Cl.

| | |
|---|---|
| ***E21B 43/26*** | (2006.01) |
| ***E21B 23/08*** | (2006.01) |
| ***E21B 33/068*** | (2006.01) |
| *E21B 43/14* | (2006.01) |
| *E21B 33/12* | (2006.01) |
| *E21B 43/116* | (2006.01) |
| *E21B 34/02* | (2006.01) |

(52) U.S. Cl.
CPC ..... *E21B 33/068* (2013.01); *E21B 43/26* (2013.01); *E21B 33/12* (2013.01); *E21B 34/02* (2013.01); *E21B 43/116* (2013.01); *E21B 43/14* (2013.01)

(58) Field of Classification Search
CPC ..... E21B 43/26; E21B 43/2607; E21B 43/11; E21B 33/12; E21B 23/08; E21B 43/263
See application file for complete search history.

(56) References Cited

U.S. PATENT DOCUMENTS

| | | | | |
|---|---|---|---|---|
| 5,040,603 | A | 8/1991 | Baldridge | |
| 6,644,844 | B2 | 11/2003 | Neal et al. | |
| 6,799,638 | B2 | 10/2004 | Butterfield, Jr. | |
| 9,127,545 | B2 * | 9/2015 | Kajaria | E21B 43/26 |
| 10,267,108 | B2 | 4/2019 | Genovese et al. | |
| 10,344,901 | B2 * | 7/2019 | Penney | E21B 41/00 |
| 10,466,719 | B2 * | 11/2019 | Kibler | E21B 43/26 |
| 11,015,413 | B2 * | 5/2021 | Guidry | E21B 43/2607 |

(Continued)

OTHER PUBLICATIONS

International Search Report and Written Opinion for International application No. PCT/US2020/037512, dated Dec. 8, 2020, 10 pages.

*Primary Examiner* — Kenneth L Thompson
(74) *Attorney, Agent, or Firm* — Polsinelli PC

(57) ABSTRACT

Aspects of the subject technology relate to systems and methods for injecting down-hole tools into a fracturing line. A fracturing system may include a fracturing line of a respective wellbore and a launcher operationally coupled to the fracturing line though a respective supply line at a pressure lower than a pressure of the fracturing line. The fracturing system may further include a magazine containing a plurality of down-hole tools that is operationally coupled to the launcher for sending a down-hole tool of the plurality of down-hole tools to the launcher. The fracturing system may also include a launching chamber operationally coupled to the respective supply line for receiving the down-hole tool and having a pressure automatically adjustable to substantially equal the pressure of the fracturing line after the launching chamber is sealed from the respective supply line for disposing the down-hole tool into the fracturing line.

20 Claims, 6 Drawing Sheets

(56) References Cited

U.S. PATENT DOCUMENTS

| | | | | |
|---|---|---|---|---|
| 2012/0211219 | A1 | 8/2012 | McGuire et al. | |
| 2014/0262302 | A1 | 9/2014 | Ferguson et al. | |
| 2014/0374089 | A1 | 12/2014 | Coles | |
| 2017/0175488 | A1 | 6/2017 | Lisowski et al. | |
| 2017/0314365 | A1 | 11/2017 | Ojong et al. | |
| 2019/0368301 | A1 | 12/2019 | Eitschberger et al. | |
| 2020/0056442 | A1* | 2/2020 | Cherewyk | E21B 34/10 |
| 2021/0148500 | A1* | 5/2021 | Farquharson | F16L 39/06 |

* cited by examiner

MULTIPLE DOWN-HOLE TOOL INJECTION SYSTEM AND METHOD

TECHNICAL FIELD

The present technology pertains to launching down-hole tools down a wellbore for conducting a fracturing job, and more particularly, to launching configurable down-hole tools for conducting a fracturing job through a fracturing line without interrupting pumping operations during the fracturing job.

BACKGROUND

One of the most common techniques used in a fracturing job is a combination of pumping special fracturing fluid, including some that contain propping agents ("proppants") down-hole of a well-bore to "fracture" rock formations along veins or planes extending from the well-bore. In performing the fracturing job, tools for perforating and plugging are required to reach their intended target locations down-hole of the well-bore.

When making perforations and plugging are accomplished in a cased hole completion approach, that entails a placement or pumping down of a bridge plug and perforation gun on a wireline to a desired stage in a wellbore and firing the gun to result in holes in the case that penetrate a reservoir section between set plugs. However, by requiring a wireline to be put in in between the pumping stages of the fracturing job, the technique results in non-productive time lost.

In recent years, ball-dropping techniques have been used to avoid using wirelines as well. However, the ball-dropping techniques are still separate procedural steps that occur in between the pumping stages and require substantial preplanning.

BRIEF DESCRIPTION OF THE DRAWINGS

In order to describe the manner in which the features and advantages of this disclosure can be obtained, a more particular description is provided with reference to specific embodiments thereof which are illustrated in the appended drawings. Understanding that these drawings depict only exemplary embodiments of the disclosure and are not therefore to be considered to be limiting of its scope, the principles herein are described and explained with additional specificity and detail through the use of the accompanying drawings in which.

DETAILED DESCRIPTION

Figure 1:
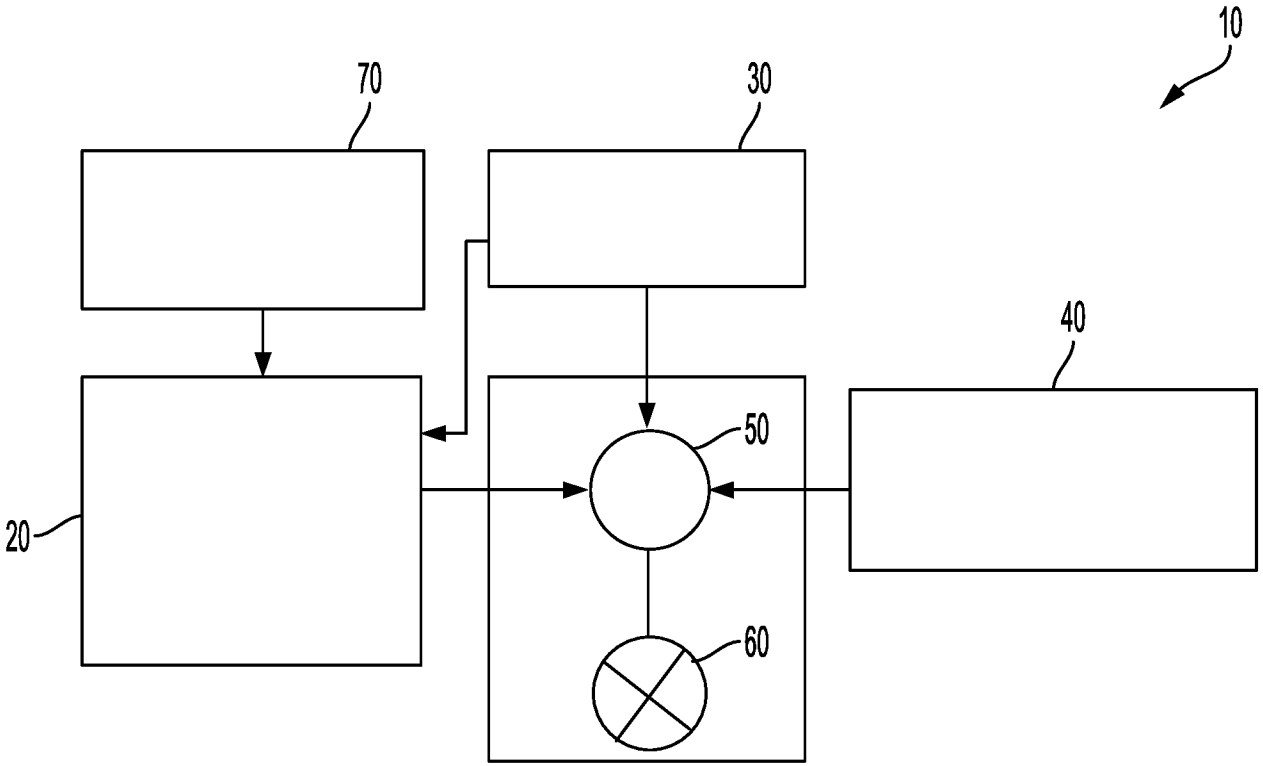
FIG. 1 is a schematic diagram of an example fracturing system, in accordance with various aspects of the subject technology.

Various embodiments of the disclosure are discussed in detail below. While specific implementations are discussed, it should be understood that this is done for illustration purposes only. A person skilled in the relevant art will recognize that other components and configurations may be used without parting from the spirit and scope of the disclosure.

Additional features and advantages of the disclosure will be set forth in the description which follows, and in part will be obvious from the description, or can be learned by practice of the principles disclosed herein. The features and advantages of the disclosure can be realized and obtained by means of the instruments and combinations particularly pointed out in the appended claims. These and other features of the disclosure will become more fully apparent from the following description and appended claims or can be learned by the practice of the principles set forth herein.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Subterranean hydraulic fracturing is conducted to increase or "stimulate" production from a hydrocarbon well. To conduct a fracturing process, pressure is used to pump special fracturing fluids, including some that contain propping agents ("proppants"), down-hole and into a hydrocarbon formation to split or "fracture" the rock formation along veins or planes extending from the well-bore. Once the desired fracture is formed, the fluid flow is reversed and the liquid portion of the fracturing fluid is removed. The proppants are intentionally left behind to stop the fracture from closing onto itself due to the weight and stresses within the formation. The proppants thus literally "prop-apart", or support the fracture to stay open, yet remain highly permeable to hydrocarbon fluid flow since they form a packed bed of particles with interstitial void space connectivity. Sand is one example of a commonly-used proppant. The newly-created-and-propped fracture or fractures can thus serve as new formation drainage area and new flow conduits from the formation to the well, providing for an increased fluid flow rate, and hence increased production of hydrocarbons.

To begin a fracturing process, at least one perforation is made at a particular down-hole location through the well into a subterranean formation, e.g. through a wall of the well casing, to provide access to the formation for the fracturing fluid. The direction of the perforation attempts to determine at least the initial direction of the fracture.

A first "mini-fracture" test can be conducted in which a relatively small amount of proppant-free fracturing fluid is pumped into the formation to determine and/or confirm at least some of the properties of the formation, such as the permeability of the formation itself. Accurately knowing the permeability allows for a prediction of the fluid leak-off rate at various pressures, whereby the amount of fracturing fluid that will flow into the formation can be considered in establishing a pumping and proppant schedule. Thus, the total amount of fluid to be pumped down-hole is at least the sum of the hold-up of the well, the amount of fluid that fills the fracture, and the amount of fluid that leaks off into the formation, the formation matrix, microfractures, natural fractures, failed or otherwise sheared fractures, and/or bedding planes during the fracturing process itself. Leak-off rate is an important parameter because once proppant-laden fluid is pumped into the fracture, leak-off can increase the concentration of the proppant in the fracturing fluid beyond a target level. Data from the mini-fracture test then is usually used by experts to confirm or modify the original desired target profile of the fracture and the completion process used to achieve the fracture.

Fracturing then begins in earnest by first pumping proppant-free fluid into the wellbore or through tubing. The fracture is initiated and begins to grow in height, length, and/or width. This first proppant-free stage is usually called the "pre-pad" and consists of a low viscosity fluid. A second fluid pumping stage is usually then conducted of a different viscosity proppant-free fluid called the "pad." At a particular time in the pumping process, the proppant is then added to a fracturing and propping flow stream using a continuous blending process, and is usually gradually stepped-up in proppant concentration. The resultant fractures are then filled with a sufficient quantity of proppant to stabilize the fractures.

This process can be repeated in a plurality of fracturing stages to form a plurality of fractures through a wellbore, e.g. as part of a well completion phase. In particular and as will be discussed in greater detail later, this process can be repeatedly performed through a plug-and-perf technique to form the fractures throughout a subterranean formation. After the fractures are formed, resources, e.g. hydrocarbons, can be extracted from the fractures during a well production phase.

As discussed previously, operators at fracturing jobs typically use wireline techniques to create perforations. Further, operators typically use wireline techniques to place isolation plugs for isolating previously formed perforations and facilitate performance of operations during a subsequent fracturing stage. However, wireline techniques are costly from both a resource utilization perspective and a time perspective. Specifically, the process of feeding a plug to a desired location in a wellbore through a wireline, setting the plug, and then pulling the wireline out of the wellbore is costly from a both a resource utilization and time perspective. More specifically, wireline techniques can consume time that a fracturing crew could otherwise use to actually pump into a wellbore during a fracturing job. For example, while the wireline is disposed in a wellbore, a fracturing treatment generally cannot be pumped into the wellbore. A fracturing treatment, as used herein, can include pumping operations performed in actually forming and stabilizing fractures into a surrounding formation through perforations in a wellbore. Further, wireline techniques involve the use of additional equipment that increases overall operational costs for a fracturing job. There therefore exist needs for systems and methods for performing fracturing jobs without the use of wireline techniques. Specifically, there exist needs for system and methods for forming perforations during a fracturing job without the use of a wireline technique. Further, there exist needs for system and methods for isolating perforations during different fracturing stages of a fracturing job without the use of a wireline technique.

Additionally and as discussed previously, using isolation plugs to separate regions of a wellbore from each other between different fracturing stages is problematic. Specifically, isolation plugs typically have to be drilled out from the wellbore during a production phase of the wellbore. This can increase production costs and impact production times during the production phase of the wellbore. Further, isolation plugs can leak after being disposed in the wellbore, thereby potentially causing damage downhole from the plug and potentially reducing the effectiveness of a treatment on planned perforations above the plug. There therefore exist needs for systems and methods for isolating perforations during different fracturing stages of a fracturing job without the use of isolation plugs.

The disclosed technology addresses the foregoing by selectively activating perforation devices disposed in a wellbore through a well intervention-less technique. Specifically, perforation devices disposed in a wellbore can be activated from a surface of the wellbore through a well intervention-less technique to ultimately form perforations through a casing of the wellbore. In turn, this can reduce the amount of time and resources that would otherwise be used to form the perforations through a wireline technique. As follows, interruptions of pumping operations caused by using a wireline technique to create the perforations can be reduced or otherwise eliminated during a fracturing job. While reference is made throughout this disclosure to overcoming the deficiencies of a wireline technique, the systems and techniques described herein can be applied to overcoming similar deficiencies present in a coil tubing technique.

Further, the disclosed technology addresses the foregoing by isolating perforations in a wellbore during different fracturing stages of a fracturing job through a well intervention-less technique. Specifically, the perforations can be isolated from each other during the different fracturing stages without disposing one or more isolation plugs into the wellbore. In turn, this can reduce the amount of time and resources that would otherwise be used in disposing the isolation plugs, e.g. through a wireline technique, into the wellbore. As follows, interruptions of pumping operations caused by disposing the isolation plugs can be reduced or otherwise eliminated during the fracturing job. Further, this can eliminate or reduce production costs associated with removing isolation plugs from the wellbore during a production phase of the wellbore.

In various embodiments, a method can include identifying one or more perforations to create during a during a fracturing stage of a fracturing job at one or more corresponding perforation sites in a wellbore through one or more perforation devices disposed in the wellbore. The one or more perforation devices can be selectively activated from a surface of the wellbore through a well intervention-less technique to selectively form the one or more perforations during the fracturing stage. The method can also include pumping a volume of fracturing fluid into the wellbore during the fracturing stage to form one or more fractures in a surrounding formation through the one or more perforations.

In certain embodiments, a system can include a plurality of perforation devices disposed in a wellbore at specific perforation sites of a plurality of perforation sites. The system can also include a surface control system implemented, at least in part, at a surface of the wellbore. The surface control system can be configured to identify one or more perforations to create during a fracturing stage of a fracturing job at one or more corresponding perforation sites of the plurality of perforation sites in the wellbore through one or more corresponding perforation devices of the plurality of perforation devices. Further, the surface control system can be configured to selectively activate the one or more perforation devices from the surface of the wellbore through a well intervention-less technique to selectively form the one or more perforations during the fracturing stage. The one or more perforation devices can be selectively activated before a volume of fracturing fluid is pumped into the wellbore during the fracturing stage to form one or more fractures in a surrounding formation through the one or more perforations.

In various embodiments, a system can include a non-transitory computer-readable storage medium having stored therein instructions which, when executed by one or more processors, cause the one or more processors to identify one or more perforations to create during a fracturing stage of a fracturing job at one or more corresponding perforation sites in a wellbore through one or more perforation devices disposed in the wellbore. Further, the instructions can cause the one or more processors to selectively activate the one or more perforation devices from a surface of the wellbore through a well intervention-less technique to selectively form the one or more perforations during the fracturing stage. The one or more perforation devices can be selectively activated before a volume of fracturing fluid is pumped into the wellbore during the fracturing stage to form one or more fractures in a surrounding formation through the one or more perforations.

Turning now to FIG. 1, an example fracturing system 10 is shown. The example fracturing system 10 shown in FIG. 1 can be implemented using the systems, methods, and techniques described herein. In particular, the disclosed system, methods, and techniques may directly or indirectly affect one or more components or pieces of equipment associated with the example fracturing system 10, according to one or more embodiments. The fracturing system 10 includes a fracturing fluid producing apparatus 20, a fluid source 30, a solid source 40, and a pump and blender system 50. All or an applicable combination of these components of the fracturing system 10 can reside at the surface at a well site/fracturing pad where a well 60 is located.

During a fracturing job, the fracturing fluid producing apparatus 20 can access the fluid source 30 for introducing/controlling flow of a fluid, e.g. a fracturing fluid, in the fracturing system 10. While only a single fluid source 30 is shown, the fluid source 30 can include a plurality of separate fluid sources. Further, the fracturing fluid producing apparatus 20 can be omitted from the fracturing system 10. In turn, the fracturing fluid can be sourced directly from the fluid source 30 during a fracturing job instead of through the intermediary fracturing fluid producing apparatus 20.

The fracturing fluid can be an applicable fluid for forming fractures during a fracture stimulation treatment of the well 60. For example, the fracturing fluid can include water, a hydrocarbon fluid, a polymer gel, foam, air, wet gases, and/or other applicable fluids. In various embodiments, the fracturing fluid can include a concentrate to which additional fluid is added prior to use in a fracture stimulation of the well 60. In certain embodiments, the fracturing fluid can include a gel pre-cursor with fluid, e.g. liquid or substantially liquid, from fluid source 30. Accordingly, the gel pre-cursor with fluid can be mixed by the fracturing fluid producing apparatus 20 to produce a viscous fracturing fluid for forming fractures.

The solid source 40 can include a volume of one or more solids for mixture with a fluid, e.g. the fracturing fluid, to form a solid-laden fluid. The solid-laden fluid can be pumped into the well 60 as part of a solids-laden fluid stream that is used to form and stabilize fractures in the well 60 during a fracturing job. The one or more solids within the solid source 40 can include applicable solids that can be added to the fracturing fluid of the fluid source 30. Specifically, the solid source 40 can contain one or more proppants for stabilizing fractures after they are formed during a fracturing job, e.g. after the fracturing fluid flows out of the formed fractures. For example, the solid source 40 can contain sand.

The fracturing system 10 can also include additive source 70. The additive source 70 can contain/provide one or more applicable additives that can be mixed into fluid, e.g. the fracturing fluid, during a fracturing job. For example, the additive source 70 can include solid-suspension-assistance agents, gelling agents, weighting agents, and/or other optional additives to alter the properties of the fracturing fluid. The additives can be included in the fracturing fluid to reduce pumping friction, to reduce or eliminate the fluid's reaction to the geological formation in which the well is formed, to operate as surfactants, and/or to serve other applicable functions during a fracturing job. As will be discussed in greater detail later, the additives can function to maintain solid particle suspension in a mixture of solid particles and fracturing fluid as the mixture is pumped down the well 60 to one or more perforations.

The pump and blender system 50 functions to pump fracture fluid into the well 60. Specifically, the pump and blender system 50 can pump fracture fluid from the fluid source 30, e.g. fracture fluid that is received through the fracturing fluid producing apparatus 20, into the well 60 for forming and potentially stabilizing fractures as part of a fracture job. The pump and blender system 50 can include one or more pumps. Specifically, the pump and blender system 50 can include a plurality of pumps that operate together, e.g. concurrently, to form fractures in a subterranean formation as part of a fracturing job. The one or more pumps included in the pump and blender system 50 can be an applicable type of fluid pump. For example, the pumps in the pump and blender system 50 can include electric pumps, gas powered pumps, diesel pumps, and combination diesel and gas powered pumps.

The pump and blender system 50 can also function to receive the fracturing fluid and combine it with other components and solids. Specifically, the pump and blender system 50 can combine the fracturing fluid with volumes of solid particles, e.g. proppant, from the solid source 40 and/or additional fluid and solids from the additive source 70. In turn, the pump and blender system 50 can pump the resulting mixture down the well 60 at a sufficient pumping rate to create or enhance one or more fractures in a subterranean zone, for example, to stimulate production of fluids from the zone. While the pump and blender system 50 is described to perform both pumping and mixing of fluids and/or solid particles, in various embodiments, the pump and blender system 50 can function to just pump a fluid stream, e.g. a fracture fluid stream, down the well 60 to create or enhance one or more fractures in a subterranean zone.

The fracturing fluid producing apparatus 20, fluid source 30, and/or solid source 40 may be equipped with one or more monitoring devices (not shown). The monitoring devices can be used to control the flow of fluids, solids, and/or other compositions to the pump and blender system 50. Such monitoring devices can effectively allow the pump and blender system 50 to source from one, some or all of the different sources at a given time. In turn, the pump and blender system 50 can provide just fracturing fluid into the well at some times, just solids or solid slurries at other times, and combinations of those components at yet other times.

Figure 2:
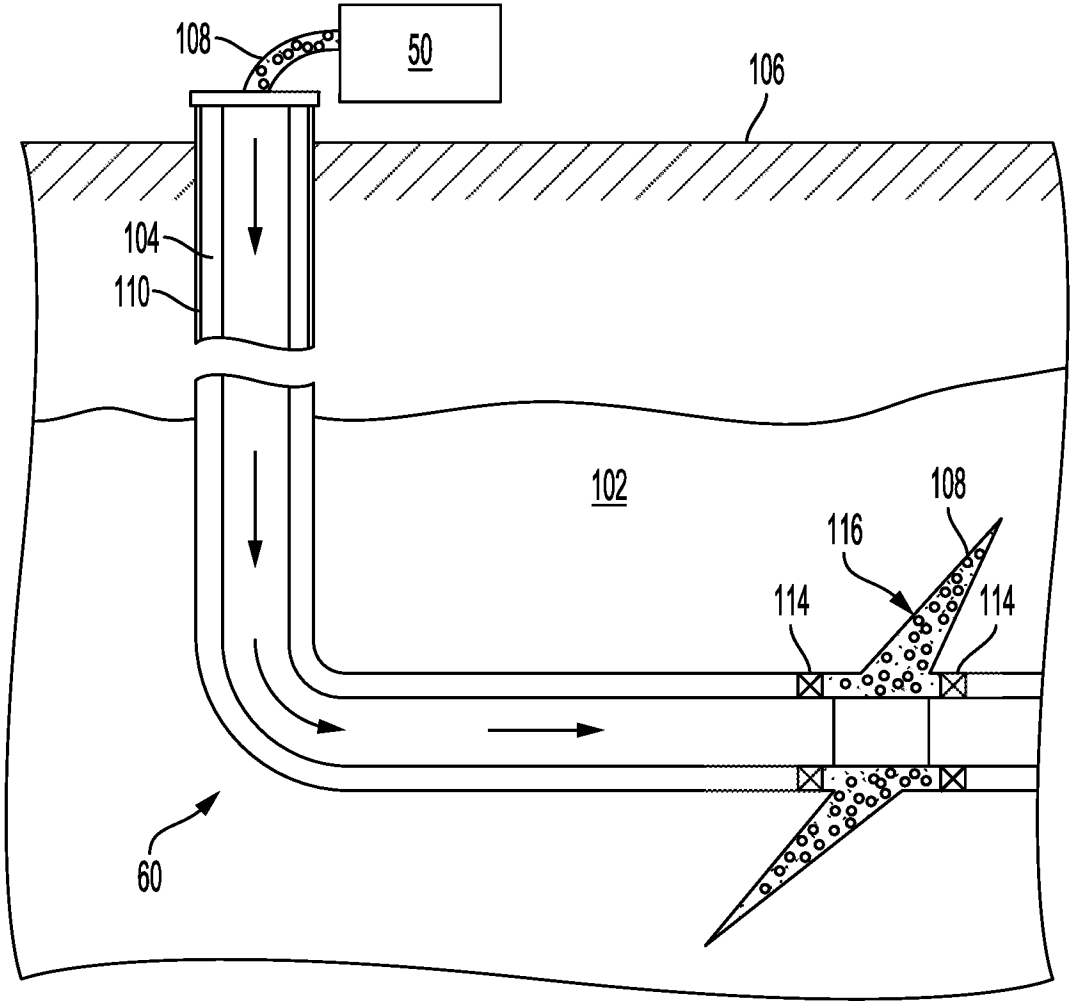
FIG. 2 shows a well during a fracturing operation in a portion of a subterranean formation of interest surrounding a wellbore, in accordance with various aspects of the subject technology.

FIG. 2 shows the well 60 during a fracturing operation in a portion of a subterranean formation of interest 102 surrounding a wellbore 104. The fracturing operation can be performed using one or an applicable combination of the components in the example fracturing system 10 shown in FIG. 1. The wellbore 104 extends from the surface 106, and the fracturing fluid 108 is applied to a portion of the subterranean formation 102 surrounding the horizontal portion of the wellbore. Although shown as vertical deviating to horizontal, the wellbore 104 may include horizontal, vertical, slant, curved, and other types of wellbore geometries and orientations, and the fracturing treatment may be applied to a subterranean zone surrounding any portion of the wellbore 104. The wellbore 104 can include a casing 110 that is cemented or otherwise secured to the wellbore wall. The wellbore 104 can be uncased or otherwise include uncased sections. Perforations can be formed in the casing 110 to allow fracturing fluids and/or other materials to flow into the subterranean formation 102. As will be discussed in greater detail below, perforations can be formed in the casing 110 using an applicable wireline-free actuation. In the example fracture operation shown in FIG. 2, a perforation is created between points 114.

The pump and blender system 50 is fluidly coupled to the wellbore 104 to pump the fracturing fluid 108, and potentially other applicable solids and solutions into the wellbore 104. When the fracturing fluid 108 is introduced into wellbore 104 it can flow through at least a portion of the wellbore 104 to the perforation, defined by points 114. The fracturing fluid 108 can be pumped at a sufficient pumping rate through at least a portion of the wellbore 104 to create one or more fractures 116 through the perforation and into the subterranean formation 102. Specifically, the fracturing fluid 108 can be pumped at a sufficient pumping rate to create a sufficient hydraulic pressure at the perforation to form the one or more fractures 116. Further, solid particles, e.g. proppant from the solid source 40, can be pumped into the wellbore 104, e.g. within the fracturing fluid 108 towards the perforation. In turn, the solid particles can enter the fractures 116 where they can remain after the fracturing fluid flows out of the wellbore. These solid particles can stabilize or otherwise "prop" the fractures 116 such that fluids can flow freely through the fractures 116.

While only two perforations at opposing sides of the wellbore 104 are shown in FIG. 2, as will be discussed in greater detail below, greater than two perforations can be formed in the wellbore 104, e.g. along the top side of the wellbore 104 or another applicable side or portion of the wellbore 104, as part of a perforation cluster. Further, multiple perforation clusters can be included in or otherwise formed during a single fracturing stage. Fractures can then be formed through the plurality of perforations in the perforation cluster as part of a fracturing stage for the perforation cluster. Specifically, fracturing fluid and solid particles can be pumped into the wellbore 104 and pass through the plurality of perforations during the fracturing stage to form and stabilize the fractures through the plurality of perforations.

Figure 3:
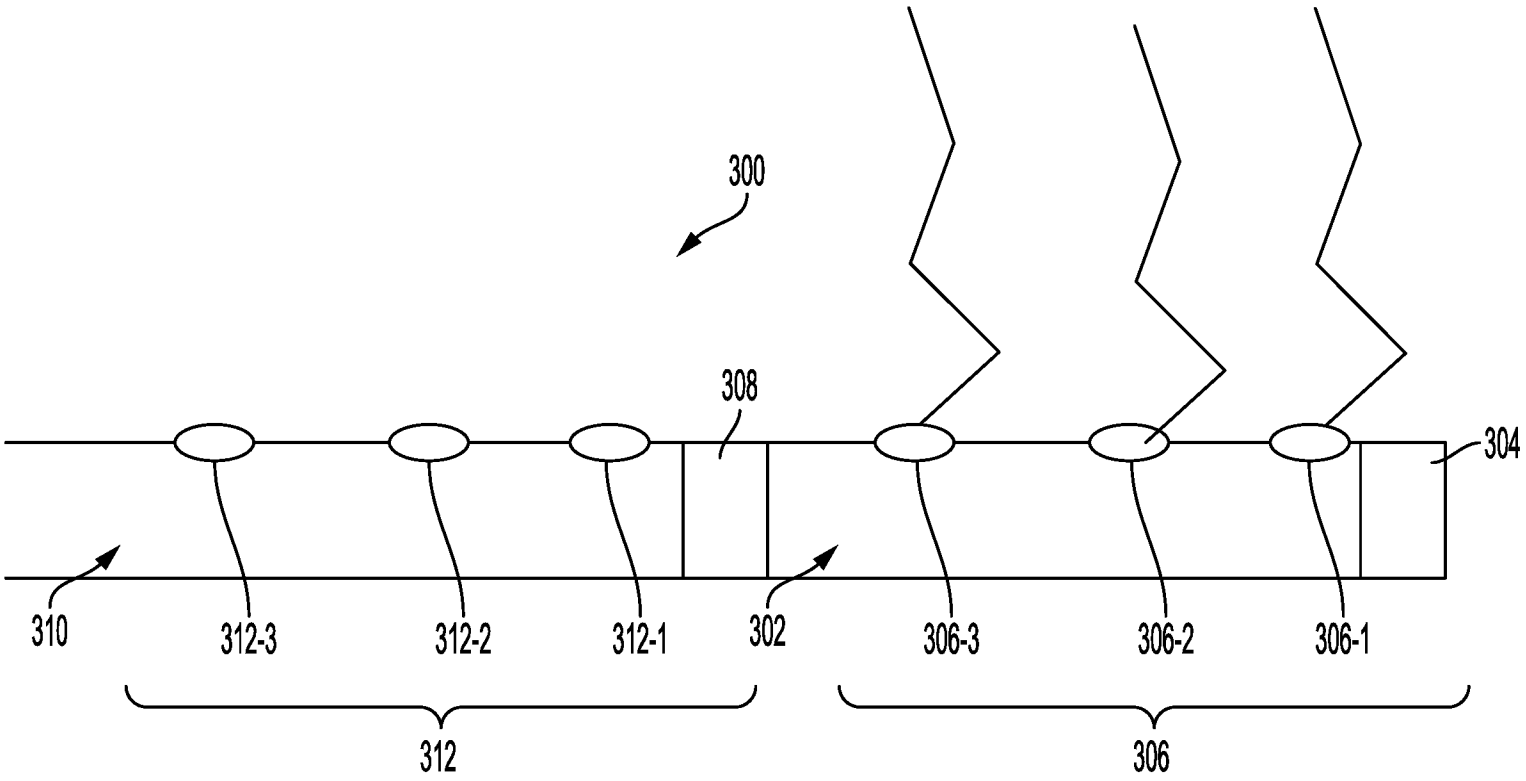
FIG. 3 shows a portion of a wellbore that is fractured using multiple fracture stages, in accordance with various aspects of the subject technology.

FIG. 3 shows a portion of a wellbore 300 that is fractured using multiple fracture stages and an isolation plug. Specifically, the wellbore 300 is fractured in multiple fracture stages using a plug-and-perf technique.

The example wellbore 300 includes a first region 302 within a portion of the wellbore 300. The first region 302 can be positioned in proximity to a terminal end of the wellbore 300. The first region 302 is formed within the wellbore 300, at least in part, by a plug 304. Specifically, the plug 304 can function to isolate the first region 302 of the wellbore 300 from another region of the wellbore 300, e.g. by preventing the flow of fluid from the first region 302 to another region of the wellbore 300. The region isolated from the first region 302 by the plug 304 can be the terminal region of the wellbore 300, e.g. the region of the wellbore 300 at the terminal end of the wellbore 300. Alternatively, the region isolated from the first region 302 by the plug 304 can be a region of the wellbore 300 that is closer to the terminal end of the wellbore 300 than the first region 302. While the first region 302 is shown in FIG. 3 to be formed, at least in part, by the plug 304, in various embodiments, the first region 302 can be formed, at least in part, by a terminal end of the wellbore 300 instead of the plug 304. Specifically, the first region 302 can be a terminal region within the wellbore 300. Such regions, e.g. the first region 302, can be formed as part of a stage in a fracturing completion process. Therefore, each region can correspond to a different fracturing stage, e.g. the fracturing stage in which the region was formed during the fracturing completion process.

The first region 302 includes a first cluster 306-1, a second cluster 306-2, and a third cluster 306-3. Each of the first cluster 306-1, the second cluster 306-2, and the third cluster 306-3 can include one or more perforations formed in the wellbore 300. For example, the first cluster 306-1 can include three perforations in the wellbore 300 and the third cluster 306-3 can include a single perforation in the wellbore 300. The first cluster 306-1, the second cluster 306-2, and the third cluster 306-3 can form a plurality of perforation clusters 306 within the first region 302 of the wellbore 300. While three clusters are shown in the plurality of perforation cluster 306, in various embodiments, the perforation clusters 306 can include fewer or more perforation clusters. As will be discussed in greater detail later, fractures can be formed and stabilized within a subterranean formation through the perforation clusters 306 within the first region 302 of the wellbore 300. Specifically, fractures can be formed and stabilized through the perforation clusters 306 within the first region 302 by pumping fracturing fluid and solid particles into the first region 302 and through the perforations of the perforation clusters 306 into the subterranean formation.

The example wellbore 300 also includes a second region 310 positioned closer to the wellhead than the first region 302. Conversely, the first region 302 is in closer proximity to a terminal end of the wellbore 300 than the second region 310. For example, the first region 302 can be a terminal region of the wellbore 300 and therefore be positioned closer to the terminal end of the wellbore 300 than the second region 310. The second region 310 is isolated from the first region 302 by a plug 308 that is positioned between the first region 302 and the second region 310. The plug 308 can fluidly isolate the second region 310 from the first region 302. As the plug 308 is positioned between the first and second regions 302 and 310, when fluid and solid particles are pumped into the second region 310, e.g. during a fracture stage, the plug 308 can prevent the fluid and solid particles from passing from the second region 310 into the first region 302.

The second region 310 includes a first perforation cluster 312-1, a second perforation cluster 312-2, and a third perforation cluster 312-3. Each of the first perforation cluster 312-1, the second perforation cluster 312-2, and the third perforation cluster 312-3 can include one or more perforations formed in the wellbore 300. The first perforation cluster 312-1, the second perforation cluster 312-2, and the third perforation cluster 312-3 can form a plurality of perforation clusters 312 within the second region 310 of the wellbore 300. While three perforation clusters are shown in the perforation clusters 312, in various embodiments, the perforation clusters 312 can include fewer or more perforation clusters. As will be discussed in greater detail later, fractures can be formed and stabilized within a subterranean formation through the perforation clusters 312 within the second region 310 of the wellbore 300. Specifically, fractures can be formed and stabilized through the perforation clusters 312 within the second region 310 by pumping fracturing fluid and solid particles into the second region 310 and through the perforations of the perforation clusters 312 into the subterranean formation.

In fracturing the wellbore 300 in multiple fracturing stages through a plug-and-perf technique, the perforation clusters 306 can be formed in the first region 302 before the second region 310 is formed. Specifically, the perforation clusters 306 can be formed before the perforation clusters 312 are formed in the second region 310. As will be discussed in greater detail later, the perforation clusters 306 can be formed using a wireline-free actuation. Once the perforation clusters 306 are formed, fracturing fluid and solid particles can be transferred through the wellbore 300 into the perforations of the perforation clusters 306 to form and stabilize fractures in the subterranean formation as part of a first fracturing stage. The fracturing fluid and solid particles can be transferred from a wellhead of the wellbore 300 to the first region 302 through the second region 310 of the wellbore 300. Specifically, the fracturing fluid and solid particles can be transferred through the second region 310 before the second region 310 is formed, and the plurality of perforation clusters 312 are formed. This can ensure, at least in part, that the fracturing fluid and solid particles flow through the second region 310 and into the subterranean formation through the perforations of the perforation clusters 306 in the first region 302.

After the fractures are formed through the perforation clusters 306-1, 306-2, and 306-3, the plug 308 can be disposed within the wellbore 300. Specifically, the plug 308 can be disposed within the wellbore 300 to form the second region 310. Then, the perforation clusters 312 can be formed, e.g. using a wireline-free actuation. Once the perforation clusters 312 are formed, fracturing fluid and solid particles can be transferred through the wellbore 300 into the perforations of the perforation clusters 312 to form and stabilize fractures in the subterranean formation as part of a second fracturing stage. The fracturing fluid and solid particles can be transferred from the wellhead of the wellbore 300 to the second region 310 while the plug 308 prevents transfer of the fluid and solid particles to the first region 302. This can effectively isolate the first region 302 until the first region 302 is accessed for production of resources, e.g. hydrocarbons. After the fractures are formed through the perforation clusters 312 in the second region 310, a plug can be positioned between the second region 310 and the wellhead, e.g. to fluidly isolate the second region 310. This process of forming perforations and perforation clusters, forming fractures during a fracture stage, followed by plugging on a region by region basis can be repeated. Specifically, this process can be repeated up the wellbore towards the wellhead until a completion plan for the wellbore 300 is finished.

Figure 4:
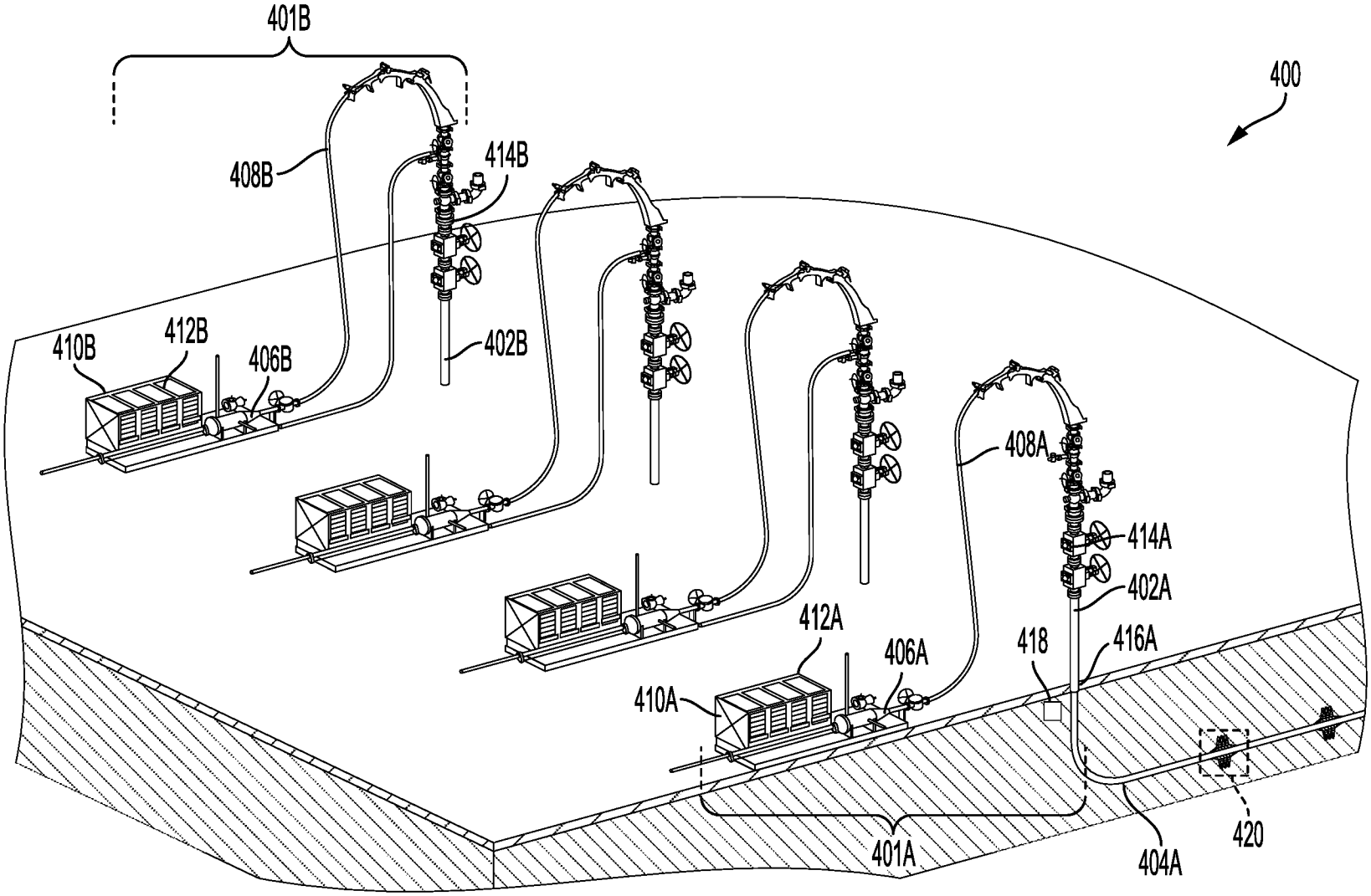
FIG. 4 is a schematic diagram of an example fracturing system, in accordance with various aspects of the subject technology.

An example fracturing system 400 is shown in FIG. 4 and can be implemented using the systems, methods, and techniques described herein. In particular, the disclosed system, methods, and techniques may directly or indirectly affect one or more components or pieces of equipment associated with the example fracturing system 400, according to one or more aspects of this disclosure. The example fracturing system 400 for conducting hydraulic fracturing may be a multi-launcher system wherein one or more wellbores (e.g., 404A) comprises one or more down-hole tool launcher systems 401 (e.g., 401A, 401B . . . 401N). More specifically, each down-hole tool launcher system 401 may include a fracturing line 402 (e.g., 402A, 402B . . . 402N) of the respective wellbore 404. The fracturing line 402 may be at a first pressure during at least a portion of a fracturing operation performed in the respective wellbore 404 through the fracturing line 402.

The down-hole tool launcher system 401 may further include a launcher 406 (e.g., 406A, 406B . . . 106N) operationally coupled to the fracturing line 402 through a respective supply line 408 (e.g., 408A, 408B . . . 408N). The fracturing line 402 and the respective supply line 408 may be absent a wireline tether for the injection of a plurality of down-hole tools 412 (including 412A, 412B . . . 412N). Instead of using the wireline tether to traverse each down-hole tool of the plurality of down-hole tools 412, the launcher 406 may launch each down-hole tool of the plurality of down-hole tools 412 using fluid pressure. The fluid pressure may be provided by a high horsepower, high pressure proppant-laden fluid. Each down-hole tool of the plurality of down-hole tools 412 may be multiple feet long. The respective supply line 408 may further include a gooseneck arch with a gradual radius bend that permits traversal of each down-hole tool of the plurality of down-hole tools 412. The respective supply line 408 may be at a second pressure may be lower than the first pressure of the fracturing line 402.

The down-hole tool launcher system 401 may further include a magazine 410 (e.g., 410A, 410B . . . 410N), each magazine 410 may contain the plurality of down-hole tools 412. The magazine 410 may be operationally coupled to the launcher 406. The magazine 410 may send a first down-hole tool 412A of the plurality of down-hole tools 412 to the launcher 406. The first down-hole tool 412A may be sent into the launcher 406 by a mechanical arm or similar methods. The plurality of down-hole tools 412 may be loaded into the magazine 410 irrespective of a specific sequence of loading the plurality of down-hole tools 412 associated with the fracturing operation. Each down-hole tool of the plurality of down-hole tools 412 may include read/write functionality, wherein each down-hole tool may be assigned a mission, via a communication mechanism 418, before reaching a target zone 420 in the respective wellbore 404. The communication mechanism 418 may utilize Bluetooth, radio-frequency identification (RFID), near-field communication, Wi-Fi, or other similar means of communication. Alternatively, or in addition to, the magazine 410 may be a programmable magazine such that each down-hole tool of the plurality of down-hole tools 412 may be assigned the mission at the magazine 410. The mission may be, for example, that the down-hole tool 412A is to serve as a plug or shoot perforations in the target zone and missions for each subsequent down-hole tool of the plurality of down-hole tools 412 may be programmed on location or set in a pre-set automated order.

The down-hole tool launcher system 401 may further include a launching chamber 414 (e.g., 414A, 414B . . .

414N). The launching chamber 414 may be operationally coupled to the launcher 406 for receiving the first down-hole tool 412A. The launching chamber 414 may be in proximity to a wellhead 416 (e.g., 416A, 416B . . . 416N) of the respective wellbore 404 through the respective supply line 408. The launching chamber 414 may be automatically sealable from the respective supply line 408 after the first down-hole tool 412A is received in the launching chamber 414. Pressure within the launching chamber 414 may be automatically adjustable to substantially equal the first pressure of the fracturing line 402 after the launching chamber 414 is sealed from respective supply line 408. The launching chamber 414 may be fluidly connected to the fracturing line 402 after the pressure of the launching chamber 414 is adjusted to substantially equal the first pressure of the fracturing line 402. Additionally, the first down-hole tool 412A is disposable from the launching chamber 414 into the fracturing line 402 fluidly connected to the launching chamber 414.

Each down-hole tool launcher system 401 of the example fracturing system 400 may be coupled to the respective wellbore 404 such that each down-hole tool launcher system 401 may include one or more other launchers 406, one or more other magazines 410 for the respective supply line 408, and/or one or more other supply lines 408 coupled to the respective fracturing line 402. Consequently, two or more magazines 410 may be arranged in parallel or arranged in series along respective supply lines 408. Furthermore, the example fracturing system 400 may include one or more other down-hole tool launcher systems 401, wherein all of the down-hole tool launcher systems 401 are fed from a common pressure source such that the respective plurality of down-hole tools 412 are controlled by a common one or more processors to streamline injections of down-hole tools 412 in respective wellbores 404.

Figure 5:
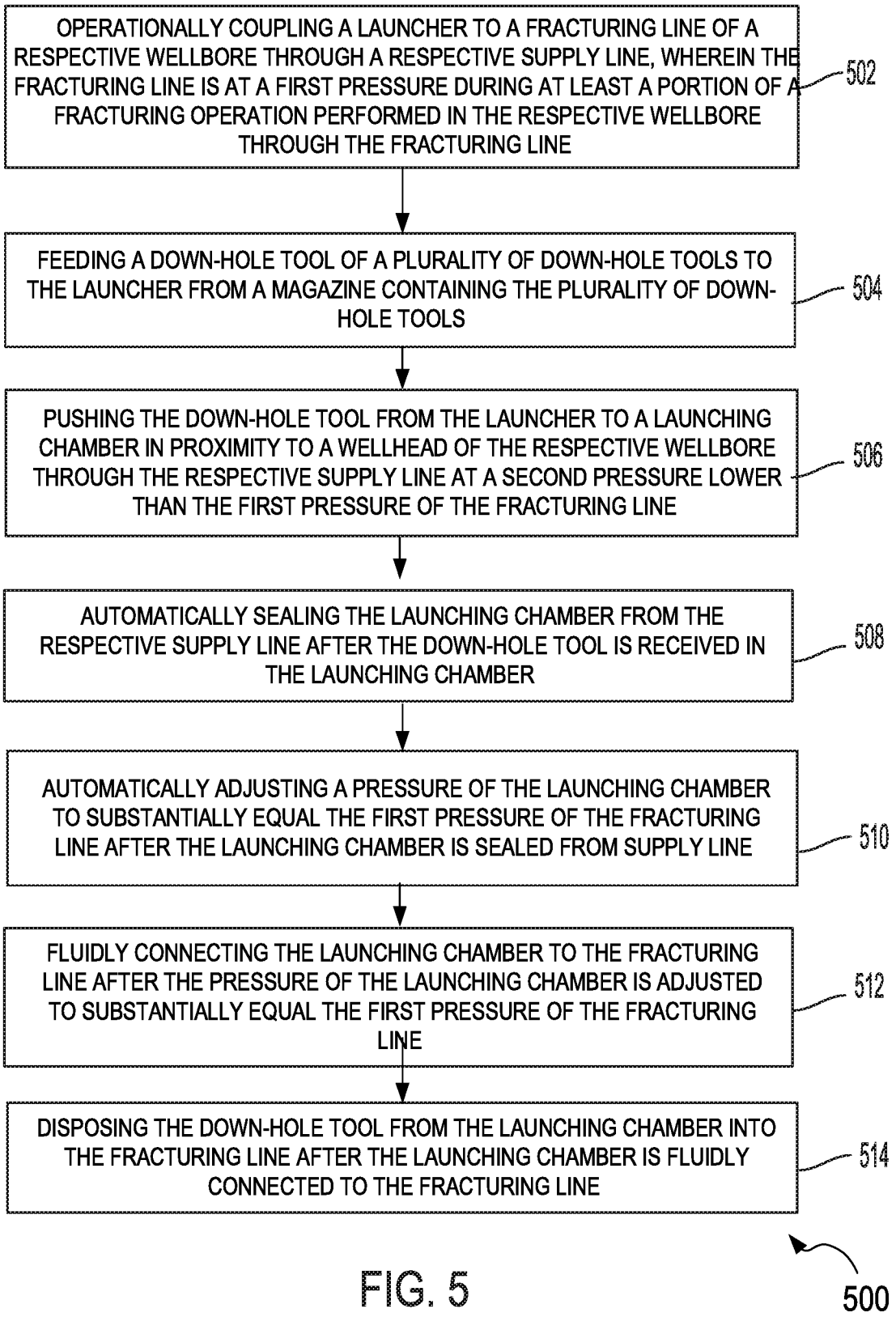
FIG. 5 shows an example method for concurrent injection of down-hole tools into the fracturing line concurrent to the fracturing operation, in accordance with some aspects of the present technology.

As shown in FIG. 5, in various aspects, an example method 500 may include operationally coupling (502) the launcher 406 to the fracturing line 402 of the respective wellbore 404 through the respective supply line 408. Operationally coupling can include physically coupling the launcher 406 to the fracturing line 402. Specifically, operationally coupling can include physically coupling the launcher 406 to the fracturing line 402 such that down-hole tools can be physically moved from the launcher to the fracturing line. For example, operationally coupling the launcher 406 to the fracturing line 402 can include physically connecting the launcher 406 to the fracturing line 402 through one or more lines through which down-hole tools can pass from the launcher 406 to the fracturing line 402.

The method may further include feeding (504) a down-hole tool 412A of the plurality of down-hole tools 412 to the launcher 406 from the magazine 410 containing the plurality of down-hole tools 412. The down-hole tool 412A can be fed from the magazine 410 to the launcher 406 according to a specific sequence. For example, the down-hole tool 412A can be loaded into the magazine 410 as part of a specific sequence of loading a plurality of down-hole tools into the magazine 410. As follows, the down-hole tool 412A can be fed from the magazine 410 to the launcher 406 based on the specific sequence in which the plurality of down-hole tools are loaded into the magazine 410. Further, the down-hole tool 412A can be fed from the magazine 410 to the launcher 406 irrespective of a specific sequence in which a plurality of down-hole tools are loaded into the magazine 410.

The method may further include pushing (506) the down-hole tool 412A from the launcher 406 to the launching chamber 414 in proximity to the wellhead 416 of the respective wellbore 404 through the respective supply line 408 at a second pressure. The second pressure may be lower than the first pressure of the fracturing line 402. This is advantageous as the supply line can be fabricated from less expensive materials than materials that would need to be used in the construction of the supply line if tools were pushed through the supply line at higher pressures. Further, this allows for the curved supply line configuration shown in FIG. 4, which can reduce the footprint of the fracturing equipment at the fracturing job.

The method may further include automatically sealing (508) the launching chamber 414 from the respective supply line 408 after the down-hole tool 412A is received in the launching chamber 414. The launching chamber 414 can be sealed from the supply line 408 through an applicable sealing technique. Further, in automatically sealing the launching chamber 414 from the respective supply line 408, the launching chamber 414 can be sealed from the supply line 408 in an automated or semi-automated fashion. Specifically, the launching chamber 414 can be automatically sealed from the respective supply line 408 by a subsystem controller and without action by an operator of the fracturing job.

The method may further include automatically adjusting (510) the pressure of the launching chamber 414 to substantially equal the first pressure of the fracturing line 402 after the launching chamber 414 is sealed from the respective supply line 408. The automatically adjusting of the pressure of the launching chamber 414 may be performed by a valve control unit that may be air-locked. Similar to as discussed previously with respect to sealing the launching chamber 414 from the respective supply line 408, the pressure of the launching chamber 414 can be adjusted in an automated or semi-automated fashion.

The method may further include fluidly connecting (512) the launching chamber 414 to the fracturing line 402 after the pressure of the launching chamber 414 is adjusted to substantially equal the first pressure of the fracturing line 402. Substantially equal, as used herein, can include when the pressure of the launching chamber 414 is either equal to the pressure of the fracturing line 402 or within a specific threshold pressure amount to the pressure of the fracturing line 402. Specifically, substantially equal can include the pressure of the launching chamber 414 and the fracturing line 402 are close enough to each other, such that when the fracturing line 402 and the launching chamber are fluidly connected to each other, the pressure in the fracturing line remains high enough to continue pumping operations during the fracturing job.

The method may further include disposing (514) the down-hole tool 412A from the launching chamber 414 into the fracturing line 402 after the launching chamber 414 is fluidly connected to the fracturing line 402. In turn, the down-hole tool 412A can be pushed downhole through the fracturing line 402. Specifically, the down-hole tool 412A can be pushed downhole as part of normal pumping operations during the fracturing job. This is advantageous as it can allow for continuous or nearly continuous pumping operations during the fracturing job.

Each down-hole tool launcher system 401 may include a plurality of subsystems that may have each have a subsystem controller communicatively coupled with an actuator. The example fracturing system 400 may include one or more processors communicatively coupled with each of the subsystem controllers and the one or more processors may have memory storing instructions that cause the one or more processors to perform any of the following methods described herein. For example, the launcher 406 and the launching chamber 414 may have a respective controller that is communicatively coupled with actuators that perform their respective actions as described above.

While the description has made reference to performing fracturing jobs as part of well completion activities, the techniques and systems described herein can be applied to any applicable situation where a fracturing job is performed. Specifically, the techniques and systems for performing a fracturing job, as described herein, can be applied to perform well workover activities. For example, the techniques and systems described herein can be applied in well workover activities to change a completion based on changing hydrocarbon reservoir conditions. In another example, the techniques and systems described herein can be applied in well workover activities to pull and replace a defective completion.

Figure 6:
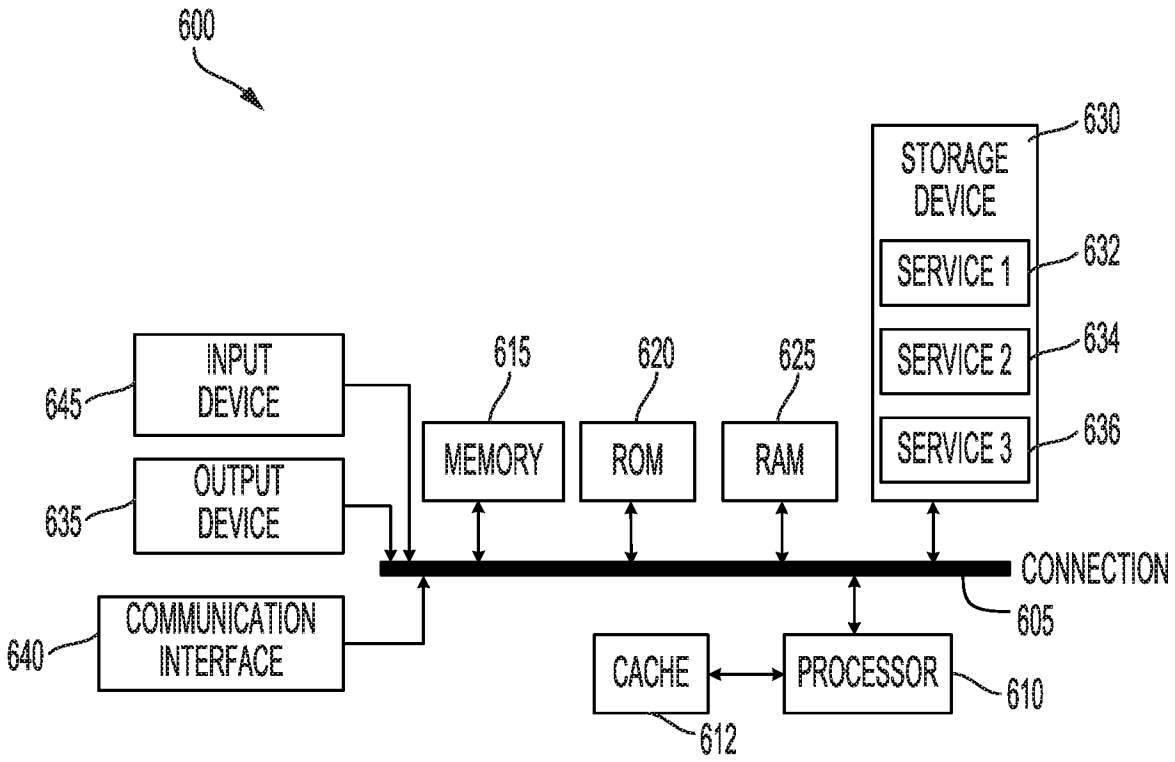
FIG. 6 shows an example of a system for implementing some aspects of the present technology.

FIG. 6 illustrates an example computing device architecture 600 which can be employed to perform various steps, methods, and techniques disclosed herein. Specifically, the techniques described herein can be implemented in an applicable fracturing system, e.g. the fracturing system 600, through a control system. The control system can be implemented, at least in part, through the computing device architecture 600 shown in FIG. 6. The various implementations will be apparent to those of ordinary skill in the art when practicing the present technology. Persons of ordinary skill in the art will also readily appreciate that other system implementations or examples are possible.

As noted above, FIG. 6 illustrates an example computing device architecture 600 of a computing device which can implement the various technologies and techniques described herein. The components of the computing device architecture 600 are shown in electrical communication with each other using a connection 605, such as a bus. The example computing device architecture 600 includes a processing unit (CPU or processor) 610 and a computing device connection 605 that couples various computing device components including the computing device memory 615, such as read only memory (ROM) 620 and random access memory (RAM) 625, to the processor 610.

The computing device architecture 600 can include a cache of high-speed memory connected directly with, in close proximity to, or integrated as part of the processor 610. The computing device architecture 600 can copy data from the memory 615 and/or the storage device 630 to the cache 612 for quick access by the processor 610. In this way, the cache can provide a performance boost that avoids processor 610 delays while waiting for data. These and other modules can control or be configured to control the processor 610 to perform various actions. Other computing device memory 615 may be available for use as well. The memory 615 can include multiple different types of memory with different performance characteristics. The processor 610 can include any general purpose processor and a hardware or software service, such as service 1 632, service 2 634, and service 3 636 stored in storage device 630, configured to control the processor 610 as well as a special-purpose processor where software instructions are incorporated into the processor design. The processor 610 may be a self-contained system, containing multiple cores or processors, a bus, memory controller, cache, etc. A multi-core processor may be symmetric or asymmetric.

To enable user interaction with the computing device architecture 600, an input device 645 can represent any number of input mechanisms, such as a microphone for speech, a touch-sensitive screen for gesture or graphical input, keyboard, mouse, motion input, speech and so forth. An output device 635 can also be one or more of a number of output mechanism shown in FIG. 6. The various implementations will be apparent to those of ordinary mechanisms known to those of skill in the art, such as a display, projector, television, speaker device, etc. In some instances, multimodal computing devices can enable a user to provide multiple types of input to communicate with the computing device architecture 600. The communications interface 640 can generally govern and manage the user input and computing device output. There is no restriction on operating on any particular hardware arrangement and therefore the basic features here may easily be substituted for improved hardware or firmware arrangements as they are developed.

Storage device 630 is a non-volatile memory and can be a hard disk or other types of computer readable media which can store data that are accessible by a computer, such as magnetic cassettes, flash memory cards, solid state memory devices, digital versatile disks, cartridges, random access memories (RAMs) 625, read only memory (ROM) 620, and hybrids thereof. The storage device 630 can include services 632, 634, 636 for controlling the processor 610. Other hardware or software modules are contemplated. The storage device 630 can be connected to the computing device connection 605. In one aspect, a hardware module that performs a particular function can include the software component stored in a computer-readable medium in connection with the necessary hardware components, such as the processor 610, connection 605, output device 635, and so forth, to carry out the function.

For clarity of explanation, in some instances the present technology may be presented as including individual functional blocks including functional blocks comprising devices, device components, steps or routines in a method embodied in software, or combinations of hardware and software.

In some embodiments the computer-readable storage devices, mediums, and memories can include a cable or wireless signal containing a bit stream and the like. However, when mentioned, non-transitory computer-readable storage media expressly exclude media such as energy, carrier signals, electromagnetic waves, and signals per se.

Methods according to the above-described examples can be implemented using computer-executable instructions that are stored or otherwise available from computer readable media. Such instructions can include, for example, instructions data which cause or otherwise configure a general purpose computer, special purpose computer, or a processing device to perform a certain function or group of functions. Portions of computer resources used can be accessible over a network. The computer executable instructions may be, for example, binaries, intermediate format instructions such as assembly language, firmware, source code, etc. Examples of computer-readable media that may be used to store instructions, information used, and/or information created during methods according to described examples include magnetic or optical disks, flash memory, USB devices provided with non-volatile memory, networked storage devices, and so on.

Devices implementing methods according to these disclosures can include hardware, firmware and/or software, and can take any of a variety of form factors. Typical examples of such form factors include laptops, smart phones, small form factor personal computers, personal digital assistants, rackmount devices, standalone devices, and so on. Functionality described herein also can be embodied in peripherals or add-in cards. Such functionality can also be implemented on a circuit board among different chips or different processes executing in a single device, by way of further example.

The instructions, media for conveying such instructions, computing resources for executing them, and other structures for supporting such computing resources are example means for providing the functions described in the disclosure.

In the foregoing description, aspects of the application are described with reference to specific embodiments thereof, but those skilled in the art will recognize that the application is not limited thereto. Thus, while illustrative embodiments of the application have been described in detail herein, it is to be understood that the disclosed concepts may be otherwise variously embodied and employed, and that the appended claims are intended to be construed to include such variations, except as limited by the prior art. Various features and aspects of the above-described subject matter may be used individually or jointly. Further, embodiments can be utilized in any number of environments and applications beyond those described herein without departing from the broader spirit and scope of the specification. The specification and drawings are, accordingly, to be regarded as illustrative rather than restrictive. For the purposes of illustration, methods were described in a particular order. It should be appreciated that in alternate embodiments, the methods may be performed in a different order than that described.

Where components are described as being "configured to" perform certain operations, such configuration can be accomplished, for example, by designing electronic circuits or other hardware to perform the operation, by programming programmable electronic circuits (e.g., microprocessors, or other suitable electronic circuits) to perform the operation, or any combination thereof.

The various illustrative logical blocks, modules, circuits, and algorithm steps described in connection with the examples disclosed herein may be implemented as electronic hardware, computer software, firmware, or combinations thereof. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present application.

The techniques described herein may also be implemented in electronic hardware, computer software, firmware, or any combination thereof. Such techniques may be implemented in any of a variety of devices such as general purposes computers, wireless communication device handsets, or integrated circuit devices having multiple uses including application in wireless communication device handsets and other devices. Any features described as modules or components may be implemented together in an integrated logic device or separately as discrete but interoperable logic devices. If implemented in software, the techniques may be realized at least in part by a computer-readable data storage medium comprising program code including instructions that, when executed, performs one or more of the method, algorithms, and/or operations described above. The computer-readable data storage medium may form part of a computer program product, which may include packaging materials.

The computer-readable medium may include memory or data storage media, such as random access memory (RAM) such as synchronous dynamic random access memory (SDRAM), read-only memory (ROM), non-volatile random access memory (NVRAM), electrically erasable programmable read-only memory (EEPROM), FLASH memory, magnetic or optical data storage media, and the like. The techniques additionally, or alternatively, may be realized at least in part by a computer-readable communication medium that carries or communicates program code in the form of instructions or data structures and that can be accessed, read, and/or executed by a computer, such as propagated signals or waves.

Other embodiments of the disclosure may be practiced in network computing environments with many types of computer system configurations, including personal computers, hand-held devices, multi-processor systems, microprocessor-based or programmable consumer electronics, network PCs, minicomputers, mainframe computers, and the like. Embodiments may also be practiced in distributed computing environments where tasks are performed by local and remote processing devices that are linked (either by hardwired links, wireless links, or by a combination thereof) through a communications network. In a distributed computing environment, program modules may be located in both local and remote memory storage devices.

In the above description, terms such as "down-hole" and the like, as used herein, shall mean in relation to the bottom or furthest extent of the surrounding wellbore even though the wellbore or portions of it may be deviated or horizontal. Correspondingly, the transverse, axial, lateral, longitudinal, radial, etc., orientations shall mean orientations relative to the orientation of the wellbore or tool. Additionally, the illustrate embodiments are illustrated such that the orientation is such that the right-hand side is down-hole compared to the left-hand side.

The term "coupled" is defined as connected, whether directly or indirectly through intervening components, and is not necessarily limited to physical connections. The connection can be such that the objects are permanently connected or releasably connected. The term "outside" refers to a region that is beyond the outermost confines of a physical object. The term "inside" indicates that at least a portion of a region is partially contained within a boundary formed by the object. The term "substantially" is defined to be essentially conforming to the particular dimension, shape or another word that substantially modifies, such that the component need not be exact. For example, substantially cylindrical means that the object resembles a cylinder, but can have one or more deviations from a true cylinder.

Although a variety of information was used to explain aspects within the scope of the appended claims, no limitation of the claims should be implied based on particular features or arrangements, as one of ordinary skill would be able to derive a wide variety of implementations. Further and although some subject matter may have been described in language specific to structural features and/or method steps, it is to be understood that the subject matter defined in the appended claims is not necessarily limited to these described features or acts. Such functionality can be distributed differently or performed in components other than those identified herein. The described features and steps are disclosed as possible components of systems and methods within the scope of the appended claims.

Moreover, claim language reciting "at least one of a set indicates that one member of the set or multiple members of the set satisfy the claim. For example, claim language reciting "at least one of A and B" means A, B, or A and B.

Statements of the disclosure include:

Statement 1. A method comprising operationally coupling a launcher to a fracturing line of a respective wellbore though a respective supply line, wherein the fracturing line is at a first pressure during at least a portion of a fracturing operation performed in the respective wellbore through the fracturing line. The method can also include feeding a down-hole tool of a plurality of down-hole tools to the launcher from a magazine containing the plurality of down-hole tools. Further, the method can include pushing the down-hole tool from the launcher to a launching chamber in proximity to a wellhead of the respective wellbore through the respective supply line at a second pressure lower than the first pressure of the fracturing line. Additionally, the method can include automatically sealing the launching chamber from the respective supply line after the down-hole tool is received in the launching chamber. The method can also include automatically adjusting a pressure of the launching chamber to substantially equal the first pressure of the fracturing line after the launching chamber is sealed from the respective supply line. Further, the method can include fluidly connecting the launching chamber to the fracturing line after the pressure of the launching chamber is adjusted to substantially equal the first pressure of the fracturing line. Additionally, the method can include disposing the down-hole tool from the launching chamber into the fracturing line after the launching chamber is fluidly connected to the fracturing line.

Statement 2. The method of statement 1, wherein the fracturing line and the respective supply line are absent a wireline tether.

Statement 3. The method of statements 1 and 2, wherein the plurality of down-hole tools are loaded into the magazine irrespective of a specific sequence of loading the plurality of down-hole tools associated with the fracturing operation.

Statement 4. The method of statements 1 through 3, wherein the down-hole tool is multiple feet long and the respective supply line comprises a goose-neck arch with a gradual radius bend that permits traversal by the down-hole tool.

Statement 5. The method of statements 1 through 4, wherein the automatically adjusting of the pressure of the launching chamber is performed by a valve control unit.

Statement 6. The method of statements 1 through 5, wherein the plurality of down-hole tools comprise read/write functionality, wherein each down-hole tool is assigned a mission, via a communication mechanism, before reaching a target zone of the respective wellbore.

Statement 7. The method of statements 1 through 6, wherein the communication mechanism is implemented through at least one of a Bluetooth communication channel, a radio-frequency identification (RFID) communication channel, a near-field communication channel, and a Wi-Fi communication channel.

Statement 8. The method of statements 1 through 7, wherein the magazine is a programmable magazine such that the down-hole tool is assigned the mission at the magazine.

Statement 9. The method of statements 1 through 8, wherein the mission is for the down-hole tool to serve as a plug or shoot perforations in the target zone and missions for each subsequent down-hole tool are programmed on location.

Statement 10. A system comprising a magazine containing a plurality of down-hole tools and a launcher operationally coupled to the magazine for receiving one or more down-hole tools of the plurality of down-hole tools. The system can also include a respective supply line for receiving the one or more down-hole tools from the launcher. Further, the system can include a launching chamber, coupled to the respective supply line for receiving the one or more down-hole tools and a fracturing line of a respective wellbore, the fracturing line at a first pressure during at least a portion of a fracturing operation and the respective supply line at a second pressure lower than the first pressure. The launching chamber can be automatically sealable from the respective supply line after the one or more down-hole tools are received in the launching chamber. Further, pressure within the launching chamber can be automatically adjustable to substantially equal the first pressure of the fracturing line after the launching chamber is sealed from the respective supply line. Additionally, the launching chamber can be fluidly connected to the fracturing line after the pressure of the launching chamber is adjusted to substantially equal the first pressure of the fracturing line. Further, the one or more down-hole tools can be disposable from the launching chamber into the fracturing line when the launching chamber is fluidly connected to the fracturing line.

Statement 11. The system of statement 10, wherein the down-hole tool is disposed downhole in the wellbore through the fracturing line absent a wireline tether.

Statement 12. The system of statements 10 and 11, wherein the plurality of down-hole tools are loaded into the magazine irrespective of a specific sequence of loading the plurality of down-hole tools associated with the fracturing operation.

Statement 13. The system of statements 10 through 12, wherein the respective supply line comprises a goose-neck arch with a gradual radius bend that can traverse each down-hole tool that is multiple feet long.

Statement 14. The system of statements 10 through 13, wherein the automatically adjusting the pressure of the launching chamber is performed by a valve control unit.

Statement 15. A fracturing system comprising one or more subsystem controllers for controlling subsystems of the fracturing system, wherein the subsystems include a launcher operationally coupled to a fracturing line of a respective wellbore though a respective supply line, wherein the fracturing line is at a first pressure during at least a portion of a fracturing operation performed in the respective wellbore through the fracturing line. The system can also include one or more processors communicatively coupled with the one or more subsystem controllers. The one or more processors can be coupled to memory storing instructions which cause the one or more processors to control the one or more subsystem controllers to perform operations comprising feeding a down-hole tool of a plurality of down-hole tools to the launcher from a magazine containing the plurality of down-hole tools. The instructions can also cause the one or more processors to push the down-hole tool from the launcher to a launching chamber in proximity to a wellhead of the respective wellbore through the respective supply line at a second pressure lower than the first pressure of the fracturing line. Further, the instructions can cause the one or more processors to automatically seal the launching chamber from the respective supply line after the down-hole tool is received in the launching chamber. Additionally, the instruction can cause the one or more processors to automatically adjust a pressure of the launching chamber to substantially equal the first pressure of the fracturing line after the launching chamber is sealed from the respective supply line. The instructions can also cause the one or more processors to fluidly connect the launching chamber to the fracturing line after the pressure of the launching chamber is adjusted to substantially equal the first pressure of the fracturing line. Additionally, the instructions can cause the one or more processors to dispose the down-hole tool from the launching chamber into the fracturing line after the launching chamber is fluidly connected to the fracturing line.

Statement 16. The system of statement 15, wherein the plurality of down-hole tools comprise read/write functionality, wherein each down-hole tool is assigned a mission before reaching a target zone via a communication mechanism.

Statement 17. The system of statements 15 and 16, wherein the communication mechanism is implemented through at least one of a Bluetooth communication channel, a radio-frequency identification (RFID) communication channel, a near-field communication channel, and a Wi-Fi communication channel.

Statement 18. The system of statements 15 through 17, wherein the magazine is a programmable magazine such that the down-hole tool is assigned the mission at the magazine.

Statement 19. The system of statements 15 through 18, wherein the mission is for the down-hole tool to serve as a plug or shoot perforations in the target zone and are programmed on location.

Statement 20. The system of statements 15 through 19, wherein the down-hole tool is disposed downhole in the wellbore through the fracturing line absent a wireline tether.

What is claimed is:

1. A method comprising:

operationally coupling a launcher to a fracturing line of a respective wellbore though a respective supply line, wherein the fracturing line is at a first pressure during at least a portion of a fracturing operation performed in the respective wellbore through the fracturing line;

feeding a down-hole tool of a plurality of down-hole tools to the launcher from a magazine containing the plurality of down-hole tools;

pushing the down-hole tool from the launcher to a launching chamber in proximity to a wellhead of the respective wellbore through the respective supply line at a second pressure lower than the first pressure of the fracturing line;

automatically sealing the launching chamber from the respective supply line after the down-hole tool is received in the launching chamber;

automatically adjusting a pressure of the launching chamber to substantially equal the first pressure of the fracturing line after the launching chamber is sealed from the respective supply line;

fluidly connecting the launching chamber to the fracturing line after the pressure of the launching chamber is adjusted to substantially equal the first pressure of the fracturing line; and disposing the down-hole tool from the launching chamber into the fracturing line after the launching chamber is fluidly connected to the fracturing line.

2. The method of claim 1, wherein the down-hole tool is disposed downhole in the respective wellbore through the fracturing line absent a wireline tether.

3. The method of claim 1, wherein the plurality of down-hole tools are loaded into the magazine irrespective of a specific sequence of loading the plurality of down-hole tools associated with the fracturing operation.

4. The method of claim 1, wherein the down-hole tool is multiple feet long and the respective supply line comprises a goose-neck arch with a gradual radius bend that permits traversal by the down-hole tool.

5. The method of claim 1, wherein the automatically adjusting of the pressure of the launching chamber is performed by a valve control unit.

6. The method of claim 1, wherein the plurality of down-hole tools comprise read/write functionality, wherein each down-hole tool is assigned a mission, via a communication mechanism, before reaching a target zone of the respective wellbore.

7. The method of claim 6, wherein the communication mechanism is implemented through at least one of a Bluetooth communication channel, a radio-frequency identification (RFID) communication channel, a near-field communication channel, and a Wi-Fi communication channel.

8. The method of claim 6, wherein the magazine is a programmable magazine such that the down-hole tool is assigned the mission at the magazine.

9. The method of claim 6, wherein the mission is for the down-hole tool to serve as a plug or shoot perforations in the target zone and missions for each subsequent down-hole tool are programmed on location.

10. A system comprising:

a magazine containing a plurality of down-hole tools;

a launcher operationally coupled to the magazine for receiving one or more down-hole tools of the plurality of down-hole tools;

a respective supply line for receiving the one or more down-hole tools from the launcher;

a launching chamber, coupled to the respective supply line for receiving the one or more down-hole tools and a fracturing line of a respective wellbore, the fracturing line at a first pressure during at least a portion of a fracturing operation and the respective supply line at a second pressure lower than the first pressure;

wherein the launching chamber is automatically sealable from the respective supply line after the one or more down-hole tools are received in the launching chamber, wherein pressure within the launching chamber is automatically adjustable to substantially equal the first pressure of the fracturing line after the launching chamber is sealed from the respective supply line;

wherein the launching chamber is fluidly connected to the fracturing line after the pressure of the launching chamber is adjusted to substantially equal the first pressure of the fracturing line, and wherein the one or more down-hole tools are disposable from the launching chamber into the fracturing line when the launching chamber is fluidly connected to the fracturing line.

11. The system of claim 10, wherein the one or more down-hole tools are disposed downhole in the respective wellbore through the fracturing line absent a wireline tether.

12. The system of claim 10, wherein the plurality of down-hole tools are loaded into the magazine irrespective of a specific sequence of loading the plurality of down-hole tools associated with the fracturing operation.

13. The system of claim 10, wherein the respective supply line comprises a goose-neck arch with a gradual radius bend that can traverse each down-hole tool that is multiple feet long.

14. The system of claim 10, wherein the automatically adjusting the pressure of the launching chamber is performed by a valve control unit.

15. A fracturing system comprising:

one or more subsystem controllers for controlling subsystems of the fracturing system, wherein the subsystems include a launcher operationally coupled to a fracturing line of a respective wellbore though a respective supply line, wherein the fracturing line is at a first pressure during at least a portion of a fracturing operation performed in the respective wellbore through the fracturing line; and one or more processors communicatively coupled with the one or more subsystem controllers, the one or more processors coupled to memory storing instructions which cause the one or more processors to control the one or more subsystem controllers to perform operations comprising:

feeding a down-hole tool of a plurality of down-hole tools to the launcher from a magazine containing the plurality of down-hole tools;

pushing the down-hole tool from the launcher to a launching chamber in proximity to a wellhead of the respective wellbore through the respective supply line at a second pressure lower than the first pressure of the fracturing line;

automatically sealing the launching chamber from the respective supply line after the down-hole tool is received in the launching chamber;

automatically adjusting a pressure of the launching chamber to substantially equal the first pressure of the fracturing line after the launching chamber is sealed from the respective supply line;

fluidly connecting the launching chamber to the fracturing line after the pressure of the launching chamber is adjusted to substantially equal the first pressure of the fracturing line; and disposing the down-hole tool from the launching chamber into the fracturing line after the launching chamber is fluidly connected to the fracturing line.

16. The system of claim 15, wherein the plurality of down-hole tools comprise read/write functionality, wherein each down-hole tool is assigned a mission before reaching a target zone via a communication mechanism.

17. The system of claim 16, wherein the communication mechanism is implemented through at least one of a Bluetooth communication channel, a radio-frequency identification (RFID) communication channel, a near-field communication channel, and a Wi-Fi communication channel.

18. The system of claim 16, wherein the magazine is a programmable magazine such that the down-hole tool is assigned the mission at the magazine.

19. The system of claim 16, wherein the mission is for the down-hole tool to serve as a plug or shoot perforations in the target zone and are missions programmed on location.

20. The system of claim 16, wherein the down-hole tool is disposed downhole in the respective wellbore through the fracturing line absent a wireline tether.

* * * * *